US011512401B2

(12) United States Patent
O'Malley et al.

(10) Patent No.: US 11,512,401 B2
(45) **Date of Patent: *Nov. 29, 2022**

(54) PROCESS FOR SHORT CHAIN ALKANE SYNTHESIS WHILE MAINTAINING FARADAIC EFFICIENCY

(71) Applicant: GRIDTHINK INC., Cheyenne, WY (US)

(72) Inventors: James O'Malley, Cheyenne, WY (US); Donald Montgomery, Cheyenne, WY (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/422,615

(22) PCT Filed: Jan. 13, 2020

(86) PCT No.: PCT/US2020/013413

§ 371 (c)(1),
(2) Date: Jul. 13, 2021

(87) PCT Pub. No.: WO2020/150174

PCT Pub. Date: Jul. 23, 2020

(65) Prior Publication Data

US 2021/0388512 A1 Dec. 16, 2021

Related U.S. Application Data

(60) Provisional application No. 62/792,324, filed on Jan. 14, 2019.

(51) Int. Cl.
*C25B 3/29* (2021.01)
*C25B 9/17* (2021.01)
(Continued)

(52) U.S. Cl.
CPC ..... *C25B 3/29* (2021.01); *C25B 3/03* (2021.01); *C25B 9/17* (2021.01); *C25B 9/73* (2021.01); *C25B 11/042* (2021.01)

(58) Field of Classification Search
None
See application file for complete search history.

(56) References Cited

U.S. PATENT DOCUMENTS 3,787,299 A 1/1974 Beck et al.
4,303,486 A 12/1981 Bard et al.
(Continued)

FOREIGN PATENT DOCUMENTS

BE 723694 A 5/1969
WO 2016170075 A1 10/2016
WO 2019157513 A1 8/2019

OTHER PUBLICATIONS

Machine translation of Ziogas et al. WO 2016170075A1 (Year: 2016).*

(Continued)

*Primary Examiner* — Wojciech Haske
(74) *Attorney, Agent, or Firm* — Ewing & Jones, PLLC

(57) ABSTRACT

There is disclosed a process for synthesis of a C2-8 alkane comprising: (a) providing an electrolyte formulation comprising from about 3N to about 6N C2-C5 carboxylic acid and from about 2 M to about 4 M alkali C2-C5 carboxylate, wherein the C2-C5 carboxylate and carboxylic acid have the same carbon alkyl length into a pressure vessel having an electrode cell or stack; (b) adding electrical current to the electrode cell or stack; (c) pressurizing the pressure vessel; and (d) recovering a gas stream from the pressure vessel comprising a C2-8 alkane, $CO_2$ and $H_2$. Preferably, the carboxylic acid is acetic acid and the alkane is ethane.

7 Claims, 1 Drawing Sheet

(51) Int. Cl.

| | |
|---|---|
| ***C25B 9/73*** | (2021.01) |
| ***C25B 3/03*** | (2021.01) |
| ***C25B 11/042*** | (2021.01) |

(56) References Cited

U.S. PATENT DOCUMENTS

| | | | | |
|---|---|---|---|---|
| 5,423,454 | A * | 6/1995 | Lippman et al. ..... | F16N 11/10<br>204/DIG. 6 |
| 8,961,775 | B2 | 2/2015 | Joshi et al. | |
| 9,783,899 | B2 | 10/2017 | Polcyn et al. | |
| 2016/0076157 | A1 * | 3/2016 | Malevich ..... | C10G 3/00<br>585/327 |

OTHER PUBLICATIONS

International Search Report issued in Application No. PCT/US2020/013413, dated Mar. 19, 2020; 2 pages.

* cited by examiner

PROCESS FOR SHORT CHAIN ALKANE SYNTHESIS WHILE MAINTAINING FARADAIC EFFICIENCY

CROSS-REFERENCE TO RELATED APPLICATION

The present invention claims priority to U.S. provisional patent application 62/792,324 filed 14 Jan. 2019.

TECHNICAL FIELD

The present disclosure provides a process for synthesis of a C2-8 alkane comprising: (a) providing an electrolyte formulation comprising from about 3N to about 6N C2-C5 carboxylic acid and from about 2M to about 4M alkali C2-C5 carboxylate, wherein the C2-C5 carboxylate and carboxylic acid have the same carbon alkyl length into a pressure vessel having an electrode cell or stack; (b) adding electrical current to the electrode cell or stack; (c) pressurizing the pressure vessel; and (d) recovering a gas stream from the pressure vessel comprising a C2-8 alkane, $CO_2$ and $H_2$. Preferably, the carboxylic acid is acetic acid and the alkane is ethane.

BACKGROUND

In the field of electrochemical synthesis, the decarboxylative dimerization of carboxylic acids is known as Kolbe electrolysis or Kolbe synthesis. For example, a method for the production of ethane, which is otherwise mined as a fossil fuel natural resource, is to perform the electrolysis of acetic acid in aqueous or organic media.

Kolbe electrolysis produces large volumes of gas at the surfaces of both anode and cathode. Hydrogen is evolved at the cathode and carbon dioxide is evolved at the anode in a ratio of 1:2 respectively. Additionally, when conducting the Kolbe electrolysis of acetic acid, a dimer product ethane is also evolved as a gas from the anode surface at an amount equivalent to the cathodic hydrogen evolution. The following chemical equation A describes the stoichiometry involved:

$$2\,CH_3COOH \xrightarrow{2e^-} C_2H_{6(g)} + H_{2(g)} + 2\,CO_{2(g)} \quad \text{(A)}$$

When gas is evolved at the electrodes, gas bubble volume displaces liquid electrolyte, thereby hindering ionic conduction between the electrodes. The result is an increased voltage for a given current density. This voltage increase is detrimental to energy efficiency of the electrochemical conversion. Therefore, there is a need in the art of Kolbe electrochemical conversion to increase energy efficiency.

Methods have been proposed to mitigate or eliminate this so-called "gas-filling effect," in the specific case of Kolbe synthesis. For example, Belgian patent 723,694 discloses a method employing a pair of vibrating electrodes which are permeable to liquids, whereby vibration and buoyancy helps to augment removal of gas bubbles from an interelectrode gap. This approach requires a complicated system and is not easily applied at an industrial scale. U.S. Pat. No. 3,787,299 (the '299 patent) describes another method of overcoming the gas-filling effect in the case of Kolbe synthesis by using a capillary gap electrode spacing of from about 0.1 to 2 mm and an electrolyte fluid phase velocity of about 0.05 to 2 m/s.

At an industrial scale, this approach has large pumping requirements, and this is not easily applied at an industrial scale.

The '299 patent also discloses that if a pressure method is used "attempts to apply this [pressure] principle to the Kolbe synthesis fail." The '299 patent shows that when conducting the Kolbe synthesis of dimethylsebacate at 16 bar(a), the faradaic efficiency for the conversion is only 28%, compared to 63% faradaic efficiency when carried out at ambient pressure. Accordingly, the present disclosure shows that a different pressure process applicable to an industrial scale is able to improve efficiency for a Kolbe process in contrast to the teaching of the '299 patent.

SUMMARY

The present disclosure provides a process for synthesis of a C2-8 alkane comprising: (a) providing an electrolyte formulation comprising from about 3N to about 6N C2-C5 carboxylic acid and from about 2M to about 4M alkali C2-C5 carboxylate, wherein the C2-C5 carboxylate and carboxylic acid have the same carbon alkyl length into a pressure vessel having an electrode cell or stack; (b) adding electrical current to the electrode cell or stack; (c) pressurizing the pressure vessel; and (d) recovering a gas stream from the pressure vessel comprising a C2-8 alkane, $CO_2$ and $H_2$. Preferably, the carboxylic acid is acetic acid and the alkane is ethane.

Preferably, the electrodes are in a stack configuration comprising alternating anodes and cathodes, or bipolar electrodes. More preferably, the electrodes have a smooth platinum surface. Preferably, the electrical current provided to the electrode cell or stack has a current density of from 20-300 mA/cm$^2$. More preferably, the current density is from 60-100 mA/cm$^2$.

Preferably, the pressure vessel is pressurized by providing a back-pressure regulator to a gaseous outlet of the pressure vessel or adding the electrolyte with a high pressure electrolyte pump, or both.

DETAILED DESCRIPTION

Figure 1:
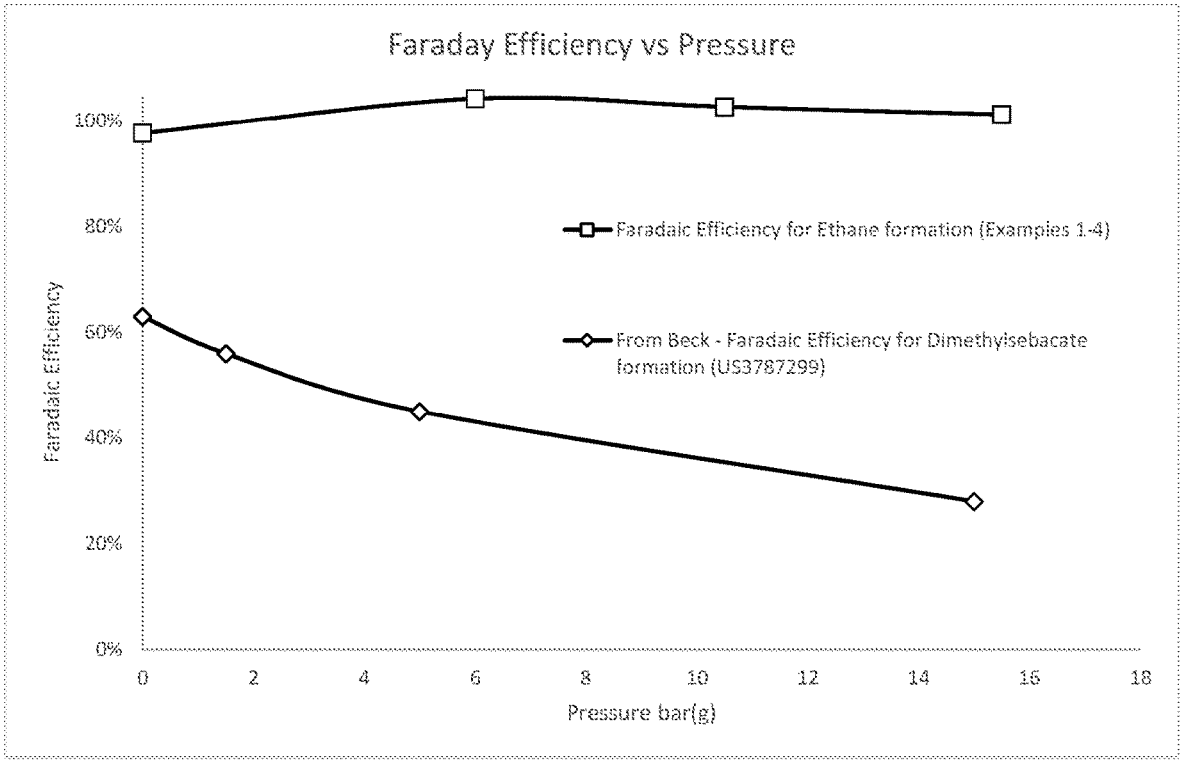
FIG. 1 shows a comparison of Faradaic efficiency for Kolbe synthesis of ethane comparing Examples 1~4 herein to the disclosure in the '299 patent.

The present disclosure is based on an unexpected finding that in the specific case of the Kolbe synthesis of ethane, the faradaic efficiency was completely preserved at above-ambient pressures, when compared to the faradaic efficiency at ambient pressure (FIG. 1). This surprising result provides for a more convenient and scalable (on an industrial basis) pressurization approach to mitigate Kolbe gas filling effect. The disclosed pressurization process can be implemented, for example, by operating a Kolbe reactor inside a pressure vessel which uses a back-pressure regulator to control operating pressure for the electrolysis. In this way, the electrolysis gases' ability to inhibit ionic transport is reduced or eliminated without the need for a complex multi-component vibration arrangement, nor a large pumping requirement, suggested by prior art approaches. An additional benefit is that the pressurized gas product has a substantially lower compressor capital cost requirement for any gas processing operations which utilizes products of the Kolbe synthesis.

Measurement of faradaic efficiencies of pressurized Kolbe reactors is performed at steady state. The examples herein use an aqueous electrolyte of 3M potassium acetate and 6N acetic acid. This electrolyte has large solubilities for the gaseous species being produced. Early attempts to measure flowrate and composition were affected by dynamically changing solubilities during pressurization. It was thus necessary to wait for long periods of time, after achieving some desired pressure, prior to sampling the bulk flow rate or the composition. Repeated sampling after a long enough waiting period showed steady compositions and flow rates.

The present disclosure provides a process for Kolbe synthesis of ethane wherein the gas filling effect can be overcome by operating the electrolysis under pressure. The disclosed process can be realized by using, for example, a back pressure regulator to control the electrolysis pressure.

The present process is operated using electrolyte formulations providing favorable voltages and faradaic efficiencies. Preferably, the electrolyte contains 2-4M potassium acetate and 4-6N acetic acid. More preferably, the electrolyte is about 3M potassium acetate and about 6N acetic acid. At these formulations, faradaic efficiencies above 90% are typical, and above 95% are achievable, even at operating pressures as high as 16 bar(a). If too much acetic acid is consumed, faradaic efficiencies begin to suffer. It is thus preferred to operate the process at a constantly maintained electrolyte concentration, although batch operation is also possible.

The disclosed process is preferably operated at current densities sufficiently high enough to give optimal faradaic efficiencies, but no so high to cause excessively high voltages. Preferably, the Kolbe reactor is operated with a current density from 20-300 mA/cm$^2$. Below 20 mA/cm$^2$, faradaic efficiencies fall, and above about 250-300 mA/cm$^2$, voltages become excessive and the electrolyte becomes unnecessarily heated, adding a requirement for cooling of the electrolyte. It is most preferred to operate the process from 60-100 mA/cm$^2$.

Calculation of the Faradaic Efficiency for Ethane Formation

A flowrate measurement apparatus used consisted of manometer formed by a 1 liter gas buret filled with concentrated sodium chloride solution which was balanced by a levelling ball. A 3-way valve selected either the composition analysis system (gas chromatograph) or flowrate measurement apparatus. Measurements were commenced by actuating the 3-way to direct gas into the gas buret, and simultaneously starting a timer. Due to intermittency in the operation of a back pressure regulator, it was necessary to measure gaseous flow for about 1 hour, while logging time and volume, and to interpret the average bulk flowrate as the slope of the best-fit line for the volume/time plot. Since the volumetric flowrate depended on laboratory conditions, these were converted to a molar rate based on actual laboratory temperature and pressure (Hg barometer located nearby in the laboratory) and based on the stoichiometric ratios in Equation A. Ethane concentrations were used as the basis for faradaic efficiency calculation. Ethane concentrations were measured by gas chromatography. The integrated response of the detector was externally calibrated with an ethane standard (NorcoLab 99.99%) in helium matrix, and the ethane concentration of the unknown was interpreted from the calibration data. Samples were analyzed with a Shincarbon ST column (Restek USA) with helium carrier under constant pressure conditions (~20 mL ambient/min).

Faradaic efficiency for ethane formation was calculated as the quotient of measured molar ethane flowrate divided by theoretical ethane flowrate; data is shown in Table 1.

TABLE 1

Data from Examples 1-4.

| Pressure bar(g) | Bulk flow rate (μmol/min) | Ethane Conc. (from GC Calibration) | Measured Ethane Flowrate (μmol/min) | Th. Ethane Flowrate (μmol/min) | Faradaic efficiency (ethane formation) |
|---|---|---|---|---|---|
| 0 | 4.10529 | 23.4% | 0.96050 | 1.0572 | 91% |
| 6 | 4.18109 | 23.9% | 0.99752 | 1.0572 | 94% |
| 10.5 | 4.19028 | 23.7% | 0.99344 | 1.0572 | 94% |
| 15.5 | 4.10904 | 23.5% | 0.96591 | 1.0572 | 91% |

Example 1

This example provides a test Kolbe synthesis device used for the results in FIG. 1 and Examples 2-4. A pressure vessel was constructed from a 2.5" pipe nipple made of class 150 stainless steel 316, and pipe caps of the same material and pressure class. A snug-fitting thin polyethylene sleeve was placed inside the pipe and was used as electrolyte reservoir. The reservoir held a total volume of 0.225 L. A Kolbe cell was constructed from cast acrylic plates with a hole drilled through the bottom to serve as an inlet, and a slot in the top as to allow free convection through the electrode gap. Solid Pt plates with a 1 mm thickness and an exposed surface area of 2.61 cm$^2$ were used as both anode and cathode, and were vertically deposed with an inter-electrode spacing of 6.75 mm. The cell was fully submerged in the electrolyte and was suspended midway down the electrolyte depth by hanging from its power wires. The upper pipe cap was fitted with a pressure gauge, an outlet port, and a power feedthrough. The outlet port was connected to a back-pressure regulator using an FKM diaphragm to enable control of the cell pressure, and the low-pressure side was vented to atmosphere through either a manometric flow rate measurement apparatus, or to a gas chromatograph equipped with TCD detector for compositional determination of $CO_2$ and ethane concentrations. A three-way valve was used to enable convenient and rapid switching from flowrate measurement to compositional analysis and vice-versa. Analyses for all examples were carried out in a high-altitude laboratory (around 6200 feet above sea level) with a typical pressure around 610 mmHg.

An initial electrolyte formulation of 3M potassium acetate and 6N acetic acid was prepared and 225 mL were initially loaded into the cell. After sealing the system, the back pressure regulator was set for ambient pressure, and the cell was operated at a constant current of 204 mA (80 mA/cm$^2$) until the system was purged with the electrolytically-produced gases. During this time the gas chromatograph was used to monitor for compositional stability, and the reported data for both flowrate and compositions were measured after achieving a steady state. By combining the flowrate data with the compositional data, the faradaic efficiency could be determined.

Example 2

The pressure vessel and measurement apparatus from example 1 were used, but with a fresh 225 mL of unused electrolyte. The back-pressure regulator was set to 6 bars gauge pressure, and the cell was allowed to purge until steady state compositions were achieved. Flowrates and composition measurements enabled derivation of the faradaic efficiency.

Example 3

The pressure vessel and measurement apparatus from example 1 were used, but with a fresh 225 mL of unused electrolyte. The back-pressure regulator was set to 10.5 bars gauge pressure, and the cell was allowed to purge until steady state compositions were achieved. Flowrates and composition measurements enabled derivation of the faradaic efficiency.

Example 4

The pressure vessel and measurement apparatus from example 1 were used, but with a fresh 225 mL of unused electrolyte. The back-pressure regulator was set to 15.5 bars gauge pressure, and the cell was allowed to purge until steady state compositions were achieved. Flowrates and composition measurements enabled derivation of the faradaic efficiency.

The data from Examples 1-4, shown in Table 1, are in stark contrast to the teaching of the '299 patent, which states: "attempts to apply this [pressure] principle to the Kolbe synthesis fail." The '299 patent further teaches that the failure is due to a substantial reduction in Faradaic efficiency for dimer formation when using back-pressure to eliminate the gas-filling effect. These data indicate the surprising result that the Faradaic efficiency for the Kolbe synthesis of short-chain alkanes does not decrease with the use of increasing back pressure.

Example 5

A Kolbe electrolyzer was configured with pumped electrolyte of the same initial composition as Example 1, an electrolyte reservoir, and a piping system to enable comparison of the pumping requirement for pressurized versus unpressurized systems. The piping system included a valve to modulate flow and a flow measurement device to indicate the volumetric flowrate of electrolyte (differential manometer for ambient trial, correlation rotameter for pressurized trials, both externally calibrated). For pressurized trials, the reactor was placed inside a pressure vessel with the gas outlet adapted to an adjustable back-pressure regulator.

Electricity was applied with a DC power supply and operated at constant current, current-limited through an electronic load. Voltages were recorded as a function of volumetric electrolyte flowrate through the Kolbe electrolyzer, and were measured at a current density of 150 $mA/cm^2$ at each of 0.8 bar(a), 6.6 bar(a), and 12.0 bar(a) pressures. Since voltages typically varied during measurement, voltages were typically recorded as the average of several measurements made over a period of time from 4-8 minutes at each flowrate. Flowrates were initially set to their highest value, voltage measurements were recorded and averaged, and then the flowrate was adjusted stepwise downward to form a data set. Trials were concluded when either the voltage began to increase significantly, indicating a gas-filled regime, or when flowrates dropped to a level outside the calibration range of the measurement device (ca. 30 mL/min). The results are shown in FIG. 2.

Figure 2:
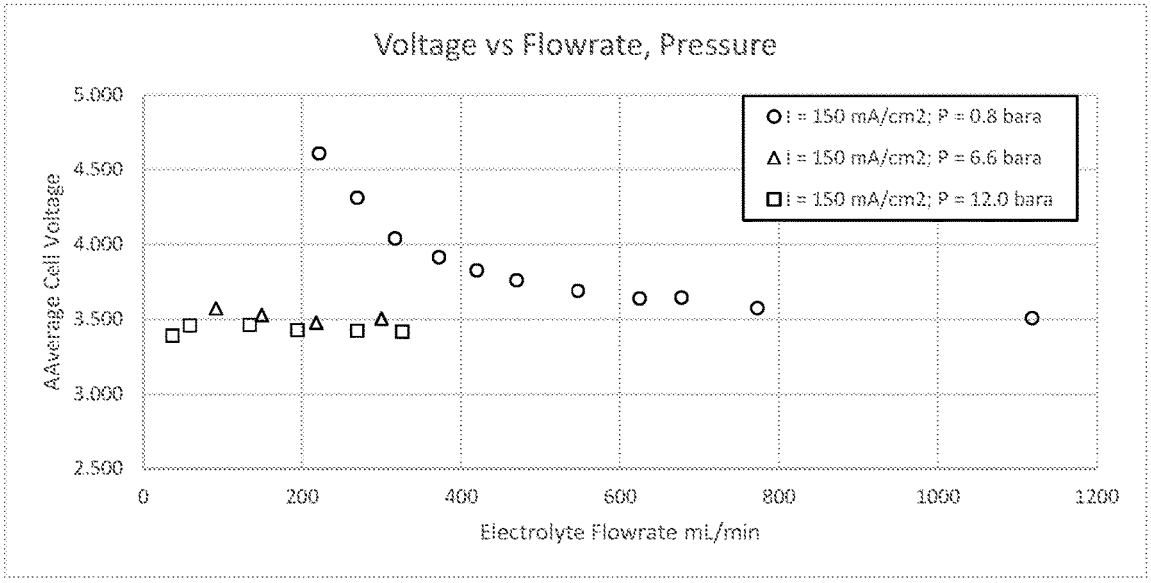
FIG. 2 shows a comparison of the pumping requirement needed to overcome gas filling effect. Shown are average cell voltages as a function of electrolyte flowrate at differing pressures.

It can be seen in FIG. 2 that when operating at 0.8 bar(a) pressure, the average cell voltage rises steeply due to gas filling of the electrolyte channels as the electrolyte flowrate drops. These data show that the detrimental effect of gas filling to the voltage can be overcome by using large flowrates. However, this crude strategy for coping with a gas filling effect will be energetically costly (detrimental to its commercial applicability). The data sets at 6 bar(a) and 12 bar(a) show that the gas filling is also eliminated by the use of pressurized operation, which has the desirable effect of reducing the overall pumping requirement significantly, thus providing for a more efficient reactor process.

We claim:

1. A process for synthesis of a C2-8 alkane comprising: (a) providing an electrolyte formulation comprising from about 3N to about 6N C2-C5 carboxylic acid and from about 2M to about 4M alkali C2-C5 carboxylate, wherein the C2-C5 carboxylate and carboxylic acid have the same carbon alkyl length into a pressure vessel having an electrode cell or stack; (b) adding electrical current to the electrode cell or stack; (c) pressurizing the pressure vessel; and (d) recovering a gas stream from the pressure vessel comprising a C2-8 alkane, $CO_2$ and $H_2$.

2. The process for synthesis of a C2-8 alkane of claim 1, wherein the carboxylic acid is acetic acid and the alkane is ethane.

3. The process for synthesis of a C2-8 alkane of claim 1, wherein the electrodes are in a stack configuration comprising alternating anodes and cathodes.

4. The process for synthesis of a C2-8 alkane of claim 3, wherein the electrodes have a smooth platinum surface.

5. A process for synthesis of a C2-8 alkane of claim 1, wherein the electrical current provided to the electrode cell or stack has a current density of from 20-300 $mA/cm^2$.

6. The process for synthesis of a C2-8 alkane of claim 5, wherein the current density is from 60-100 $mA/cm^2$.

7. The process for synthesis of a C2-8 alkane of claim 1, wherein the pressure vessel is pressurized by providing a back-pressure regulator to a gaseous outlet of the pressure vessel or adding the electrolyte with a high-pressure electrolyte pump, or both.

* * * * *